United States Patent [19]

Davis et al.

[11] 4,050,432

[45] Sept. 27, 1977

[54] FUEL INJECTION PUMP AND GOVERNOR AND TIMING CONTROL SYSTEM THEREFOR

[75] Inventors: Charles W. Davis; Robert Raufeisen, both of Simsbury; Daniel Edwin Salzgeber, Windsor, all of Conn.

[73] Assignee: Stanadyne, Inc., Hartford, Conn.

[21] Appl. No.: 597,974

[22] Filed: July 22, 1975

[51] Int. Cl.[2] ..... F02M 59/20

[52] U.S. Cl. ..... 123/139 AQ; 123/139 AL; 123/140 FG; 417/252

[58] Field of Search ..... 123/139 AL, 139 AM, 123/139 AP, 139 AQ, 140 FG; 417/245, 252, 253, 462

[56] References Cited

U.S. PATENT DOCUMENTS

| | | | |
|---|---|---|---|
| 2,641,238 | 6/1953 | Roosa | 417/252 X |
| 3,219,020 | 11/1965 | Roosa | 123/139 AL |
| 3,363,568 | 1/1968 | Evans | 417/252 X |
| 3,460,479 | 8/1969 | Kemp | 417/252 |
| 3,536,421 | 10/1970 | Kemp | 417/253 X |
| 3,897,764 | 8/1975 | Bakti | 123/139 AM X |
| 3,968,779 | 7/1976 | Davis | 123/140 R X |

FOREIGN PATENT DOCUMENTS

| | | | |
|---|---|---|---|
| 956,561 | 4/1964 | United Kingdom | 123/139 AM |

*Primary Examiner*—Carroll B. Dority, Jr.

*Assistant Examiner*—Tony M. Argenbright

*Attorney, Agent, or Firm*—Prutzman, Hayes, Kalb & Chilton

[57] ABSTRACT

The present invention provides a liquid fuel injection pump suited for the sequential delivery of measured charges of liquid fuel under high pressure to an associated engine in timed relationship therewith comprising pump chamber means wherein the charges are pressurized to high pressure, a passage for delivering the fuel to said pump chamber means, a metering valve in said passage for reglating the amount of fuel in said measured charges of fuel, said metering valve comprising a pair of relatively movable members respectively having ports in the adjacent surfaces thereof adapted for registry, means to vary the amount of overlap of said ports in a first direction to control the quantity of fuel in each measured charge of fuel in accordance with the load on the associated engine, and means for controlling the relative movement of said members in a second direction transverse to said first direction to vary the amount of overlap of said ports in said second direction in accordance with the speed of the associated engine whereby the amount of overlap in said second direction increases with increased engine speed thereby to maintain the quantity of fuel in sequential charges of fuel at a substantially constant level for a given setting of said means regardless of changes in engine speed.

25 Claims, 8 Drawing Figures

FIG. 2

Figure 1:
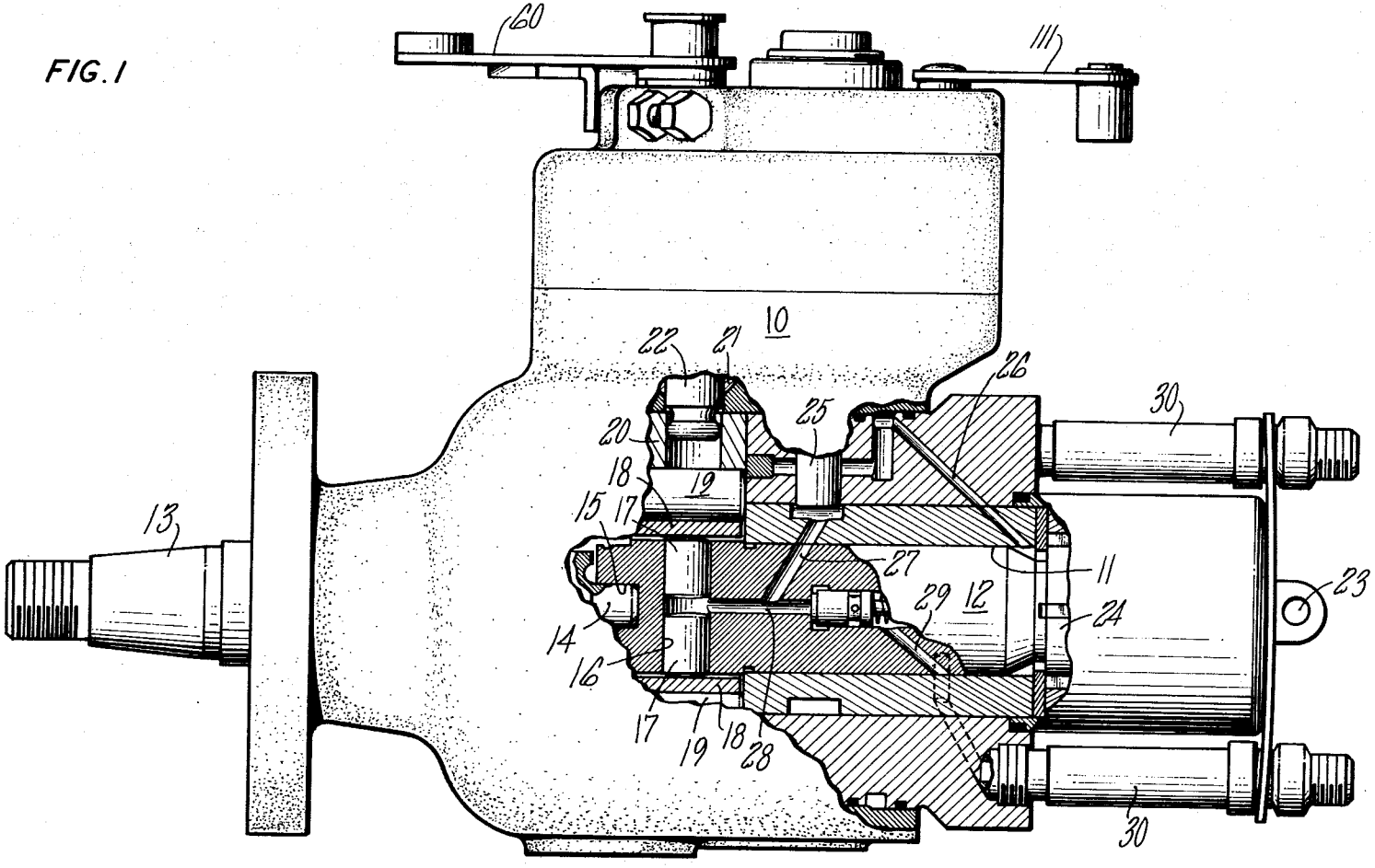

FIG. 2A
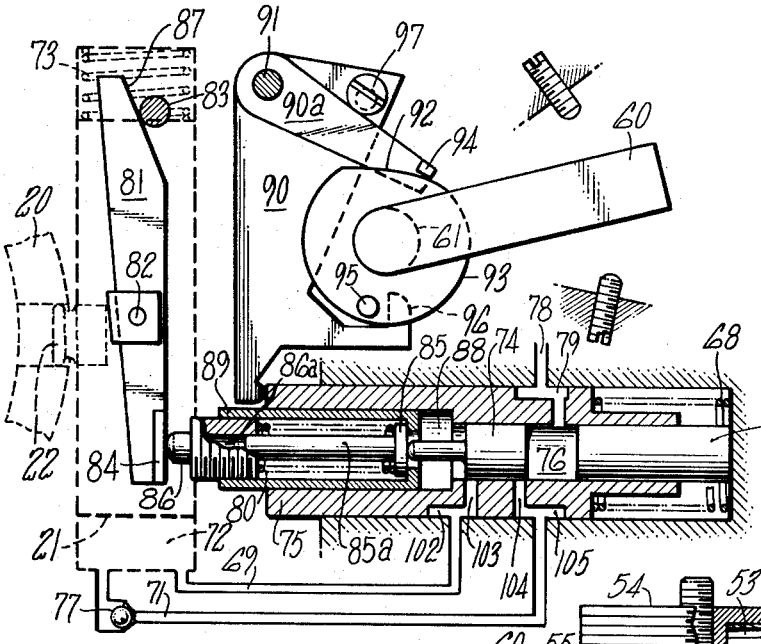
FIG. 2B
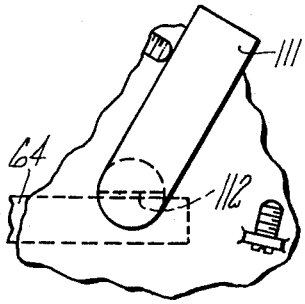
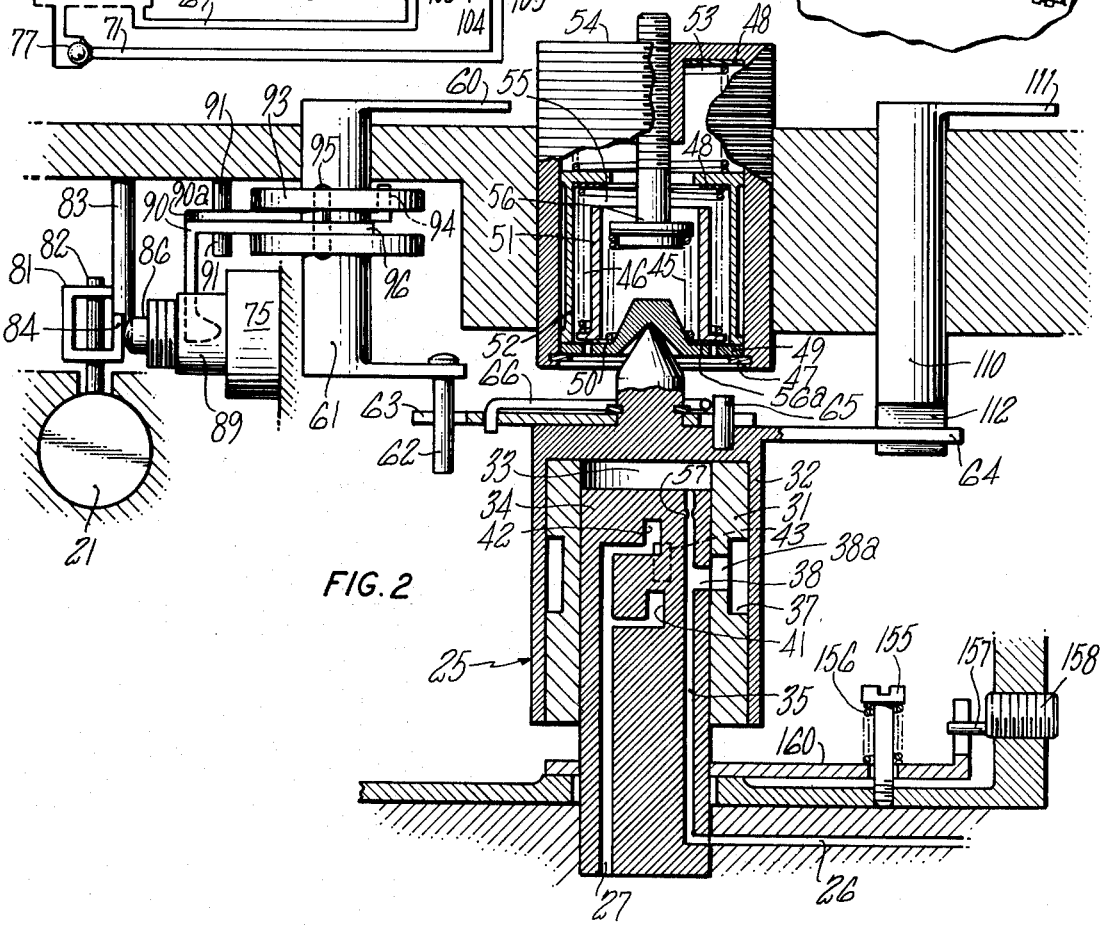
FIG. 2

FIG. 3A
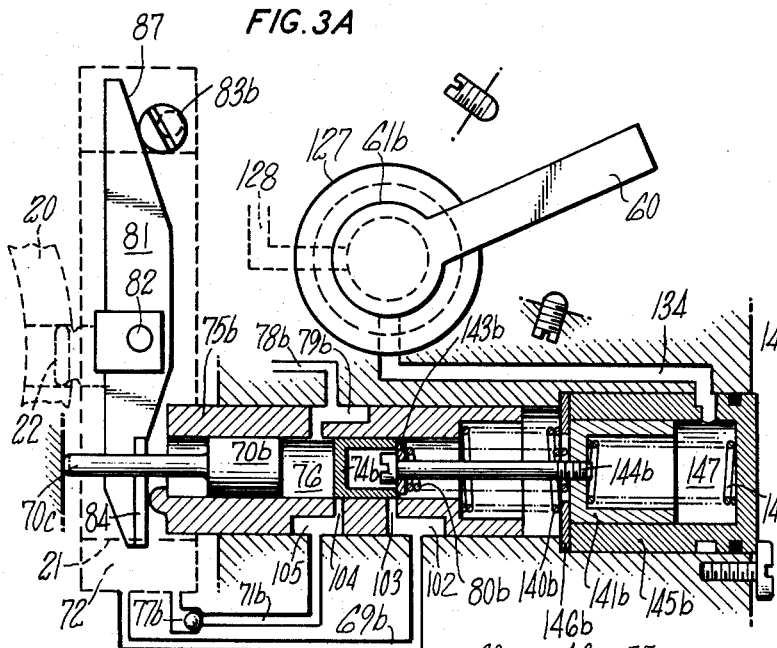
FIG. 3B
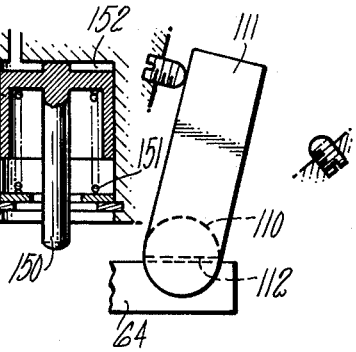
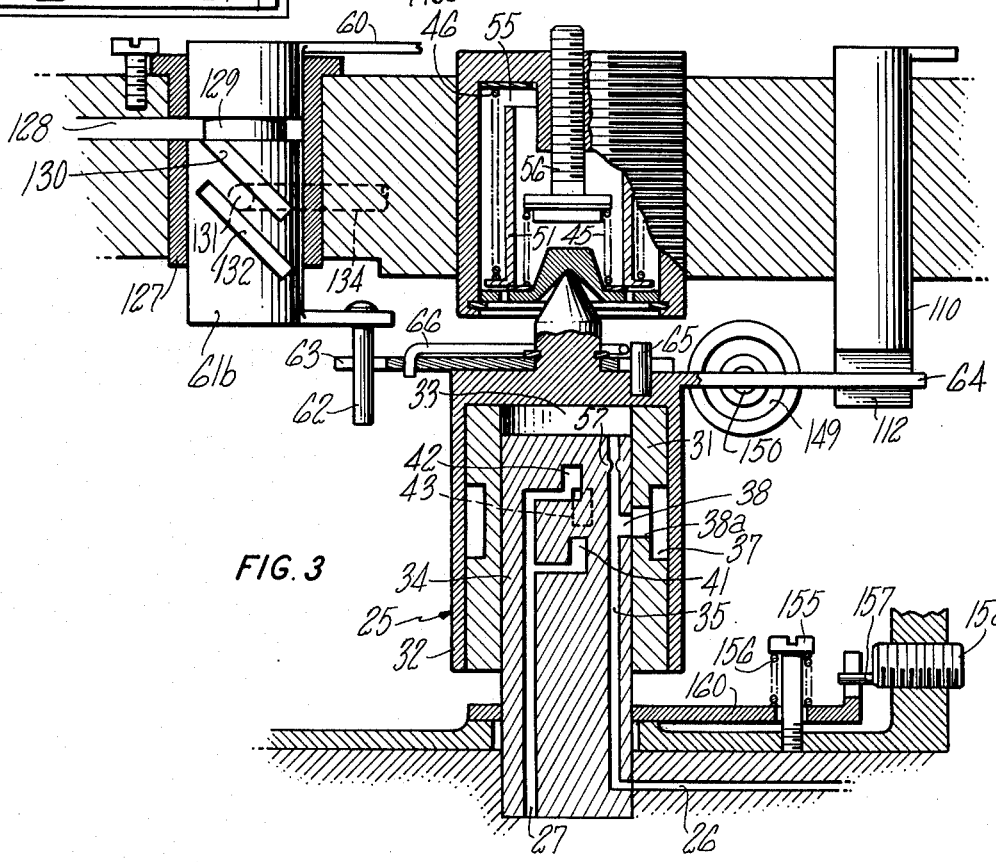
FIG. 3

FUEL INJECTION PUMP AND GOVERNOR AND TIMING CONTROL SYSTEM THEREFOR

The present invention relates to fuel injection pumps of the type used for sequentially delivering measured charges of fuel to the several cylinders of an internal combustion engine. More particularly, the present invention relates to the governing and injection timing control system for a rotary distributor pump wherein the timing and quantity of fuel delivery by the pump is automatically controlled in accordance with engine operating conditions.

In the operation of internal combustion engines where fuel injection is employed, metered charges of liquid fuel are delivered under high pressure to the engine cylinders in timed relationship with their operation. Normally, it is desirable to change the injection timing of the pump relative to the engine when engine speed is changed. In addition, it is also normally desirable to modify the injection timing of the pump in accordance with the amount of load on the engine to improve its efficiency of operation as well as to control the exhaust emissions from the engine.

Accordingly, it is the primary object of this invention to provide a new and novel injection timing control for fuel injection pumps which varies the injection timing of the pump as required for efficient operation and exhaust emissions control under varying engine operating conditions.

It is another object of this invention to provide such an injection timing control which is readily adapted to a wide variety of engines.

It is a further object of the invention to provide a new and novel governor and timing control system for fuel injection pumps which regulates the timing of fuel injection in accordance with both speed and load.

Other objects will be in part obvious and in part pointed out more in detail hereinafter.

Figure 4:
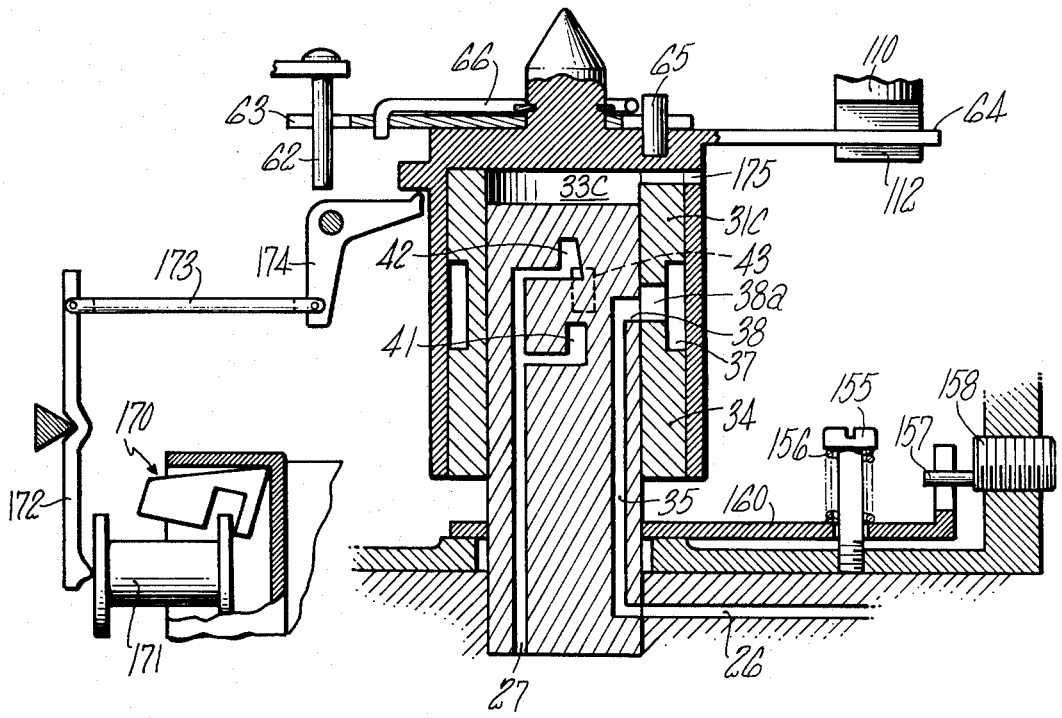

A better understanding of the invention will be obtained from the following detailed description and the accompanying drawings of an illustrative application of the invention. In the drawings:

FIG. 1 is a side elevation view, partly in section of a fuel pump incorporating the invention;

FIGS. 2, 2A, and 2B are related schematic views of a preferred embodiment of the governor and timing control system of the invention;

FIGS. 3, 3A, and 3B are views similar to FIGS. 2, 2A, and 2B showing another preferred embodiment of the invention; and FIG. 4 is an enlarged fragmentary sectional view of a further modified form of the invention.

For the purpose of illustration, there is shown in FIG. 1 a rotary distributor fuel injection pump having a pump housing 10 providing a central bore 11 in which the distributor rotor 12 is journaled. A pump shaft 13, suitably journaled in the housing 10, is connected to drive the rotary distributor 12 through a tang 14 of the shaft which engages a slot 15 formed in the rotor 12. The rotor 12 is provided with a transverse bore 16 in which a pair of pistons 17 are freely slidable. At the ends of the pistons 17 are a pair of reciprocable shoes 18 in which rollers 19 are mounted. The shoes 18 and rollers 19 are mounted for radial reciprocation by the rotor 12 and rotate with the rotor. The rollers engage a cam ring 20 having a plurality of arcuately spaced lobes around its inner periphery to actuate the plungers 17 as the rotor is rotated thereby to pressurize the sequential charges of fuel positioned in the bore 16 between the pistons 17. The rotational position of the cam 20 may be varied by means of a transversely disposed advance piston 21 which is connected to the cam ring 20 by a connector 22.

In general, fuel is delivered to the pump through inlet 23 and is pressurized by a positive displacement low pressure supply or transfer pump 24 which delivers its output to a metering mechanism 25 through passage 26. From the metering mechanism 25, fuel is delivered to the bore 16 through passages 27, 28 where the sequential charges of fuel are pressurized as the contour of the inner periphery of the cam 20 is translated into pumping strokes of the pistons 17 and delivered through passage 29 and to one of a plurality of discharge conduits 30 for sequential delivery to the associated cylinders of the associated engine.

As is well understood, the rotational position of the cam ring 20 determines the injection timing of the fuel pump.

The structure as so far described is well known and is generally similar to that shown in U.S. Pat. No. 2,877,754.

FIGS. 2, 2A, and 2B are schematic representations of a preferred form of the invention. The metering mechanism 25 comprises a cylindrical metering sleeve 31 nested in a cup-shaped cover 32 to form a closed chamber 33 with cylindrical metering rod 34. Except for calibration adjustments, metering rod 34 is fixed within the pump but is axially and angularly slidable with respect to metering sleeve 31. The metering sleeve 31 is moved axially with respect to metering rod 34 so that the volume of chamber 33 is increased in response to increases in the pressure of the output of the transfer pump 24 as speed increases and is positioned angularly with respect to metering rod 34 manually as hereinafter described.

Longitudinal passage 35 in metering rod 34 continuously communicates with passage 26 to deliver output pressure from low pressure transfer pump 24. Passage 35 is normally connected with annular groove 37 is sleeve 31 via radial passage 38 in metering rod 35 and communicating passage 38*a* in sleeve 31. Passage 35 also leads to closed chamber 33 at the upper end of metering rod 35. The output of the transfer pump 24 is therefore normally connected to annulus 37 and chamber 33. Passage 35 preferably includes a restricted orifice 57 to dampen flow to and from chamber 33 for improved stability.

A second passage 27 connects with a passage 28 (FIG. 1) for supplying fuel to the bore 16 between high pressure pumping pistons 17 of the injection pump. Passage 27 is also connected with idle metering port 41 formed on the surface of metering rod 34 and with rectangular inner main metering port 42 also formed on the surface of metering rod 34. A rectangular outer main metering port 43 is cut through the inner surface of sleeve 31 from annular groove 37. It is apparent that the metering area to regulate the flow of fuel to the pumping plungers from passage 26 to passage 27 is controlled by the amount of overlap of main metering ports 42 and 43 and that said overlap will depend on the axial and angular position of sleeve 31.

Port 43 in sleeve 31 communicates with idle metering port 41 when sleeve 31 is near its lowest speed position regardless of the angular position of sleeve 31 (except at shut-off), and this registry begins before ports 42 and 43 cease to register. However, for idle operation, metering sleeve 31 is rotated angularly as hereinafter set forth so that ports 42 and 43 do not overlap.

The angular position of metering sleeve 31 is controlled manually as later described and is the basic means for regulating fuel delivery except for automatic governor control at idle and maximum speeds. Upward axial movement of metering sleeve 31 increases the area overlap of ports 42 and 43 for a fixed angular position of metering sleeve 31. This provides metering area compensation with speed such that fuel delivery per stroke is substantially constant, regardless of variations in engine speed, for any given angular position of sleeve 31, and the angular position is, therefore, a true mechanical indicator of load (fuel delivery) at any speed. The desirability of this novel feature will be apparent in connection with injection timing control described later.

The axial position of metering sleeve 31 is controlled by the pressure in chamber 33 and the opposing forces of idle governing spring 45, compensating spring 46, and high speed governing spring 53. Retaining washer 49 is held in spring housing 54 by snap ring 47 and biasing springs 46 and 53 are preloaded as required through the use of shims 48. Compensating spring 46 is preloaded so that it will start to deflect at a speed just above idle, with maximum deflection limited by the length of gap 55. Spring 53 is preloaded to start deflecting at rated or maximum speed. The rate of spring 53 is relatively low so that upward motion of sleeve 31 is rapid above rated speed. Spring housing 54 is adjusted axially to obtain the desired initial axial overlap of metering ports 42 and 43.

At the idle speed (i.e., when port 43 communicates with idle port 41), idle spring seat 50 does not contact the bottom of compensating spring seat 51. However, at all speeds slightly above idle speed, spring seat 50 is biased into contact with compensating spring seat 51 (as shown) making idle spring 45 ineffective. During operation at idle speed, when port 43 is positioned to register with idle port 41 only, up and down motion of sleeve 31 in response to speed change will regulate the area of registry of port 41 and port 43 to control the idle speed of the engine. Idle speed and the idle spring cut-out speed are respectively adjusted by the position of adjusting screw 56 and shim **56*a* which is positioned between idle spring seat 50 and compensating spring seat 51. Idle speed droop is adjusted by the angular overlap of ports 41 and 43.**

As speed increases above rated speed, continued upward motion of sleeve 31 cuases the registry of ports 38 and **38*a* to become less such that these ports now regulate flow from passage 26 to passage 27 instead of ports 42 and 43. Fuel delivery to the engine is thereby decreased to prevent further increase of speed. The width of registry of ports 38 and 38*a* is large compared to its height, such that the flow area is very sensitive to the axial position of sleeve 31.**

The angular position of metering sleeve 31 is controlled by direct mechanical linkage with manually operated throttle or control lever 60. Throttle 60 is attached to control shaft 61 which mounts an eccentric pin 62. Pin 62 engages a radial slot in arm 63 mounted on sleeve cover 32. Angular movement of throttle 60 will cause angular movement of metering sleeve 31 without restraining up-down motion of sleeve 31.

Arm 63 is mounted for limited rotation relative to sleeve cover 32 but is biased against pin 65 in cover 32 by torsion spring 66. This arrangement permits metering sleeve 31 to be rotated by arm 64 to move port 43 out of registry with ports 42 and 41 for shut-off while arm 63 is held in fixed position by flexing torsion spring 66.

Shut-off shaft 110 is rotatably mounted in the pump housing and has a flat 112 positioned adjacent to arm 64 so that flat 112 does not contact arm 64 during all normal operation. However, it shut-off lever 111 is moved clockwise, as viewed in FIG. 2B, to its shut-off position, flat 112 will engage arm 64 and cause arm 64 and metering sleeve 31 to be rotated clockwise so that slot 43 cannot register with either port 42 or idle port 41 and fuel delivery does not take place.

Advance piston 21 is slidably mounted in a transverse bore of the pump housing and is connected to a cam ring 20 by a connector 22 in a conventional manner. Fuel under pressure is supplied through passage 71 via one-way valve 77 to advance chamber 72 at the end of advance piston 21 to move piston 21 upward against the opposing forces caused by high pressure pumping (and optional spring 73), thus causing pump injection timing to advance. Fuel is vented from chamber 72 via passage 69 spilled to the housing cavity which is maintained at a fixed low pressure, to cause advance piston 21 to move downwardly and retard injection timing. Spring 73 biases advance piston 21 to the maximum retard position when the engine is stopped. It does not otherwise affect the amount or rate of timing change.

The flow in passages 71 and 69 is regulated by servo valve 74 which is slidably mounted in an axial bore of servo sleeve 75 which in turn is slidably mounted in a bore of the pump housing. Plug 70 is also slidably mounted in the bore of servo sleeve 75. Servo valve 74, plug 70 and servo sleeve 75 form chamber 76 which is filled with fuel having a speed related pressure as a result of receiving the output of transfer pump 24 via passage 78 and elongated port 79. The force on valve 74 caused by the pressure in chamber 76 is opposed by biasing spring 80 which in turn engages feedback beam 81 through flange 84 and spring seat 86. As shown, feedback beam 81 pivots around pin 82 fixed to advance piston 21 and is provided with a shaped surface 87 which moves relative to pin 83, which is shown as being fixed to the pump housing so that flange 84 of feedback beam 81 moves to the right (as viewed in FIG. 2A) as advance piston 21 moves up to advance injection timing, or to the left as advance piston 21 moves down to retard injection timing.

Spring 80 is preloaded between outer spring seat 86 and inner spring seat 85 through spring sleeve 89 which is slidably mounted in servo sleeve 75. The shank **85*a* of inner spring seat 85 is guided in a bore 86*a* in outer seat 86. Spring 80 will not be deflected until the load applied by the pressure in chamber 76 exceeds the preload level, and the amount of deflection is limited by the engagement of the end of the shank 85*a* of inner seat 85 and outer seat 86.** It will be apparent that the amount of preload and the amount of deflection allowed will determine the speeds at which speed advance starts and stops respectively.

Servo sleeve 75 is urged left to contact load advance lever 90 by spring 68. Load advance lever 90 pivots about pin 91 which is fixed to the pump housing. Arm **90*a* is adjustable relatively to lever 90 and contacts cam profile 92 of load advance cam 93 through cam follower 94. Eccentric screw 97 on lever 90 permits rotational adjustment of arm 90a about pin 91 with respect to lever 90 and provides a predetermined initial timing adjustment. Load advance cam 93 is fixed to control shaft 61 and rotates therewith. Pin 95 protrudes axially from load advance cam 93 so that when throttle 60 is moved counterclockwise to the idle position, pin 95 engages idle step 96 on load advance lever 90**.

The ends of servo valve 74 control the flow of fuel from chamber 76 to chamber 72 at the end of the advance piston 21 via port 104, elongated slot 105 and passage 71, and the spill of fuel from chamber 72 to the pump housing via passage 69, elongated slot 102 and port 103. Servo valve 74 is just long enough to close both ports 103 and 104 at the same time. Chamber 72 can, therefore, be connected to passage 78 to receive output fuel under transfer pump pressure, or to chamber 88 for spilling fuel to the low pressure cavity of the pump housing, or neither one depending on the axial position of servo valve 74 relative to ports 103 and 104.

Assuming the engine is operating under equilibrium conditions, advance piston 21 is held in some intermediate position by the fuel in chamber 72 with ports 103 and 104 closed. It will be understood that port 104 may be slightly open if necessary to make up for fuel leakage from chamber 72. If engine speed increases, the pressure in chamber 76 increases due to the increased output pressure of the transfer pump at the higher speed, servo valve 74 is moved left against the bias of spring 80, and port 104 is opened to provide communication between chamber 76 and advance chamber 72 so that fuel flows into advance chamber 72 and moves advance piston 21 upward to advance the timing of injection. Since shaped surface 87 of feedback beam 81 engages pin 83, feedback beam 81 rotates counterclockwise around pin 82 moving servo valve 74 to the right through spring seat 86, spring 80, and spring seat 85 to reclose port 104. If engine speed slows down, servo valve 74 moves to the right to open port 103 to housing pressure chamber 88 and fuel is spilled from chamber 72 to retard the timing. The engagement between shaped surface 87 and pin 83, as advance piston 21 moves downwardly, causes lever 81 to rotate clockwise moving spring seat 86, spring 80, spring seat 85 and servo valve 74 to the left to reclose port 103.

From the foregoing discussion, it is apparent that a unique arrangement is provided for causing injection timing to advance with increasing speed and retard with decreasing speed.

If throttle 60 and shaft 61 are rotated counterclockwise as viewed in FIG. 2A, eccentric pin 62 engages arm 63 of the metering mechanism 25 to cause sleeve 31 to rotate clockwise to decrease fuel flow because of the reduced registry of ports 42 and 43. Simultaneously, the engagement of cam follower 94 with load advance cam surface 92 causes lever 90 to rotate counterclockwise around pin 91 and move servo sleeve 75 to the right. Since servo valve 74 remains in the same position, the movement of servo sleeve 75 causes port 104 to open so that fuel flows into advance chamber 72 from chamber 76 causing advance piston 21 to move up to advance injection timing. Feedback beam 81 is, therefore, rotated counterclockwise about pin 82 causing spring 80 and servo valve 74 to move to the right reclosing port 104. If throttle 60 is moved further counterclockwise to the low idle speed position, rotation of load advance cam 93 will, after termination of angular registry of metering slots 42 and 43, result in the engagement of pin 95 and idle step 96 moving servo sleeve 75 further to the right to cause an abrupt additional advance of injection timing at idle speed.

Similarly, if the engine is operating at some intermediate speed and load condition and throttle 60 is moved to a higher load position, clockwise rotation of load advance cam 93 causes cam follower 94 to rotate lever 90 clockwise, sleeve 75 moves to the left under the bias of spring 68, port 103 is opened to spill fuel from chamber 72, the advance piston 21 retards, feedback beam 81 rotates clockwise allowing spring 80 and servo valve 74 to move to the left reclosing port 103.

The desired relationship between the profile 92 of load advance cam 93 and the metering ports 41, 42, 43 in metering sleeve 31 and metering rod 34 is provided by adjusting the angular position of metering rod 34. A slot in adjusting arm 160 which is fixed to rotate with metering rod 34 engages an eccentric pin 157 on screw 158 that extends through the pump housing. Rotation of screw 158 causes rotation of metering rod 34 and a change in the relative angular positions of the metering ports 41, 42, 43 for a given position of load cam 93. Arm 160 is held in proper angular and axial alignment by spring 156 and screw 155 which is threaded into the pump housing through an angular slot in adjusting arm 160.

From the foregoing, it will be apparent that injection timing may be caused to advance with decreasing load and retard with increasing load by an amount and in a manner prescribed by cam profile 92 of load advance cam 93 and idle step 96. While such an advance of timing with decreasing load generally desired, it is obvious that cam profile 92 can be shaped to cause advance or retard, or a combination thereof. Moreover, regardless of the change of injection timing with load that is selected, it is apparent that such a change in injection timing with load is combined with a speed advance characteristic that is determined by the variation of transfer pump pressure with speed and the rate and preload of servo spring 80 and limited only by the maximum allowable movement of the pump cam ring 20. The amount of timing change with load can be substantially constant at all speeds or can be made to incresase with increasing speed by suitably profiling surface 87 of feedback beam 81 and, if necessary, the surface 84 of beam 81.

From the foregoing, it is apparent that by virtue of the area compensation feature resulting from the use of increasing axial overlap of rectangular metering slots 42 and 43 with increasing speed, the angular position of metering sleeve 31 and of advance cam 93 is indicative of load at any speed and the control of injection timing due to changes in load may be scheduled independently of the control of injection timing due to changes in speed.

FIGS. 3, 3A, and 3B disclose an alternate arrangement for controlling the injection timing and for providing high speed governing.

As shown in FIG. 3B, a piston 149 is slidably mounted in a bore of the pump housing to form a closed chamber 152 at one end of the piston. An actuator rod 150 formed on the piston 149 is positioned to engage arm 64 when the transfer pressure in chamber 152 overcomes preloaded spring 151. The preload on spring 151 is set so that the transfer pressure in chamber 152 can overcome the spring force when engine speed exceeds rated speed. The clockwise rotation of arm 64, as viewed in FIG. 3B, results in less registry between ports 42 and 43 to reduce fuel delivery to passage 27 and to the high pressure pumping chamber between the pumping pistons 17. It will be noted that where this form of high speed governing is provided, spring 53 of the embodiment of FIG. 2 is omitted and the spring cup 52 which is used in that design may be formed as a part of the spring housing 54. In other respects, the metering, governing, and shut-off arrangements of FIGS. 3, 3A, and 3B are the same as those of FIGS. 2, 2A, and 2B.

In the alternate arrangements of FIGS. 3, 3A, and 3B, the load advance input signal to the advance mechanism is hydraulic rather than mechanical as it is in FIG. 2.

Control shaft 61*b*, mounted in sleeve 127, has two angularly disposed parallel slots 130 and 132 formed in its surface. Slot 130 is in communication with the output of transfer pump 24 via passage 128 and groove 129 and slot 132 communicates with the housing cavity. Port 131 in sleeve 127 is sufficient in size to slightly overlap both slot 130 and slot 132, and is in communication with passage 134. The pressure in passage 134 is equal to transfer pressure, housing pressure, or has some intermediate value depending on the angular position of shaft 61*b*, and is, therefore, a function of both load and speed and increases with both increasing speed and load.

The advance piston 21 is servo controlled as in the embodiment of FIG. 2. Servo valve 74*b* and plug 70*b* are slidably mounted in servo sleeve 75b which in turn is slidably mounted in the pump housing. A pin 70*c* extending from plug 70*b* engages the pump housing. Chamber 76 between servo valve 74*b* and plug 70*b* is in communication with transfer pump outlet pressure via elongated slot 79*b* and passage 78*b*. As previously stated, output pressure from the transfer pressure increases with increased engine speed and urges servo valve 74*b* to the right against the bias of spring 80*b* which is positioned between spring seat 143*b* and load piston 141*b* and is preloaded by screw 144*b* extending from piston 141*b*. The head of screw 144*b* extends into servo valve 74*b* when spring 80*b* is deflected. Load piston 141*b* is slidably mounted in sleeve 145*b* which is fixed in the pump housing and fixes the position of a fixed washer 146*b*. Washer 146*b* serves as a stop for piston 141*b* and as a seat for spring 140*b* which urges servo sleeve 75*b* to the left into engagement with the flange 84 of feedback beam 81 which is pivotally mounted on pin 82 of advance piston 21. The profiled surface 87 engages eccentric pin 83*b* which is fixed in the pump housing. Load piston 141*b* is urged against washer 146*b* by spring 142*b* and the load sensitive pressure in chamber 147 developed by the communication between slots 130 and 132, and port 131. The area of load piston 141*b* is larger than the area of servo valve 74*b* so that load piston 141*b* cannot be moved to the right by the force of transfer pressure on servo valve 74*b* until the pressure in chamber 147 is less than a fraction of transfer pressure which depends on the area ratio of servo valve 74*b* and load piston 141*b*, and the preload of spring 142*b*.

In operation, if the engine is running at some intermediate speed and at full load and speed increases, the pressure in chamber 76 which is connected to the output of the transfer pump 24 increases, servo valve 74*b* moves to the right so that fuel is admitted to advance chamber 72 via port 104, slot 105 and passage 71*b* causing advance piston 21 to advance injection timing. Such movement of advance piston 21 also causes feedback beam 81 to rotate counterclockwise around pin 82 to move servo sleeve 75*b* to the right to reclose port 104. If speed decreases, the pressure in chamber 76 decreases, servo valve 74*b* moves to the left to open port 103 to spill fuel from advance chamber 72 to cause advance piston 21 to move to retard injection timing and to permit feedback beam 81 to rotate clockwise so that servo sleeve 75*b* may move to the left under the bias of spring 140*b* to reclose port 103.

The rotation of eccentric pin 83*b* provides for the adjustment of the initial injection timing adjustment. The preload of spring 80*b* determines the speed at which speed advance starts and the spring rate of spring 80*b* determines the rate of speed advance. The end clearance between the of screw 144*b* and servo valve 74*b* determines the amount of speed advance. Surface 87 on feedback beam 81, and the flange 84 thereof, may be profiled to provide an advance which is linear or non-linear with speed as desired.

If the engine is operating at full load and at some intermediate speed and the load is reduced, the pressure in chamber 147 will be reduced due to the reduction of the pressure in passsage 134 and the force due to transfer pressure in chamber 76 acting on servo valve 74*b* will cause servo valve 74*b* and load piston 141*b* to move to the right in unison until the increase in the biasing force of spring 142*b* equals the reduction of force on piston 141*b* caused by the lowered pressure in chamber 147. This motion results in port 104 being opened to admit output pressure from the transfer pump 24 to enter advance chamber 72 to move advance piston 21 until the feedback signal provided by feedback beam 81 recloses port 104 by the same sequence of events as described previously. An increase in load and in the pressure in chamber 147 will now cause a retarding of injection timing with the same sequence of events previously described but with the motions in the reverse direction.

FIG. 4 illustrates a modified form of the invention similar to that of FIG. 2 wherein mechanical flyweight force is substituted for the hydraulic pressure of the output of transfer pump 24 and is used to position the metering sleeve according to engine speed.

As shown in FIG. 4, a flyweight mechanism 170 causes metering sleeve 31*c* to move axially along metering rod 34 against the force of biasing springs 45, 46, and 53 (see FIG. 2). Governor force and motion is transmitted via governor sleeve 171, governor lever 172, push rod 173, and bell crank 174 to move governor sleeve 31*c* axially against the force of the biasing springs. Chamber 33*c* is isolated from transfer pump output pressure and is vented to the cavity of the pump housing via passage 175 so that the pressure in chamber 33*c* does not affect the metering function. Since the usual flyweight force increases at a rate somewhat greater than the square of engine speed, and does not provide the linear relationship required for area compensation to provide for constant fuel delivery to the pump regardless of change of speed, a variable rate area compensation spring (i.e., spring 46 of FIG. 2) will, therefore, be required, or alternatively the axial edge of metering slot 42 that engages slot 43 can be angled as shown in FIG. 4.

As will be apparent to persons skilled in the art, various modifications, variations and adaptations can be made from the foregoing specific disclosure without departing from the teachings of the present invention.

We claim:

1. A liquid fuel injection pump suited for the sequential delivery of measured charges of liquid fuel under high pressure to an associated engine in timed relationship therewith comprising pump chamber means wherein the charges are pressurized to high pressure, a passage for delivering the fuel to said pump chamber means, a metering valve in said passage for regulating the amount of fuel in said measured charges of fuel, said metering valve comprising a pair of relatively movable members respectively having ports in the adjacent surfaces thereof adapted for registry, first means to vary the amount of overlap of said ports in a first direction to control the quantity of fuel in each measured charge of fuel in accordance with the load on the associated engine, and second means for controlling the relative movement of said members in a second direction transverse to said first direction to vary the amount of overlap of said ports in said second direction in accordance with the speed of the associated engine to increase the amount of overlap in said second direction with increased engine speed to maintain the quantity of fuel in sequential charges of fuel at a substantially constant level for a given setting of said first means regardless of changes in engine speed.

2. The liquid fuel injection pump according to claim 1 wherein said ports on said pair of relatively movable members are generally rectangular in shape.

3. The liquid fuel injection pump according to claim 1 wherein said pair of relatively movable members comprise a cylindrical rod and a sleeve surrounding said rod and wherein the relative angular movement of said members constitutes the movement in said first direction and the relative axial movement of said members constitutes the movement in the second direction.

4. The liquid fuel injection pump according to claim 3 wherein said sleeve is closed at one end to form a control chamber with said cylindrical rod, a low pressure supply pump associated with said fuel injection pump generates an output pressure correlated with engine speed, spring means for applying a bias to reduce the volume of said control chamber, and a passage for delivering the output of said low pressure supply pump to said control chamber.

5. The liquid fuel injection pump according to claim 4 wherein said ports on said relatively movable members are rectangular in shape with an edge thereof parallel with the axis of said rod and said sleeve.

6. The liquid fuel injection pump according to claim 4 wherein a second port is provided on the surface of said cylindrical rod in a position which is axially spaced from the first port thereon, said second port being adapted to register with the port on said sleeve under idle conditions to provide for idle speed operation.

7. The liquid fuel injection pump according to claim 1 wherein the second means for controlling the relative movement of said members in said second direction is a centrifugal governor operatively connected to said one of said relatively movable members.

8. The liquid fuel injection pump according to claim 3 wherein means are provided for controlling the speed of the engine above a predetermined speed, said means comprising a control means which overrides the means for controlling the angular overlap of the ports forming the metering valve.

9. The liquid fuel injection pump according to claim 1 wherein means are provided for controlling the speed of the engine above a predetermined speed, said means comprising override control means responsive to a control signal correlated with engine speed.

10. The liquid fuel injection pump according to claim 3 wherein the means for varying the amount of overlap of said ports in said first direction is a throttle lever operatively connected to one of said pair of relatively movable members.

11. The liquid fuel injection pump according to claim 10 wherein the means for controlling the relative movement of said members in said second direction is a centrifugal governor operatively connected to said one of said relatively movable members.

12. The liquid fuel injection pump according to claim 11 wherein said one of said relatively movable members is said sleeve.

13. The liquid fuel injection pump according to claim 11 wherein means is provided for advancing and retarding the timing of the delivery of fuel to the associated engine, and means responsive to speed and load related signals for controlling said timing means.

14. The liquid fuel injection pump according to claim 13 including a mechanical throttle having a cam associated with a position of said throttle to provide said load related signal.

15. The liquid fuel injection pump according to claim 14 including a low pressure supply pump associated with said fuel injection pump and generating an output pressure correlated with engine speed, said output pressure comprising said speed related signal for controlling said timing.

16. The liquid fuel injection pump according to claim 13 wherein said advance mechanism comprises a piston mounted in a bore in the pump, a closed chamber at one end of said piston, means to control the quantity of fuel in said closed chamber and a feedback mechanism comprising a pivoted beam member having a profiled surface and a stop member engageable therewith to provide a feedback signal to said control means to control the quantity of fuel in said closed chamber, one of said members being mounted by said piston and the other of said members being mounted in fixed position whereby the movement of said piston causes relative movement of said members to translate the profile of said surface into said feedback signal.

17. A liquid fuel injection pump suited for the sequential delivery of measured charges of liquid fuel under high pressure to an associated engine in timed relationship therewith comprising a pump housing, a rotor journaled in a bore in said pump housing, a transverse bore in the rotor forming a high pressure pump chamber, a pair of pump plungers slidably mounted in said bore, an angularly shiftable cam ring surrounding said plungers and having inwardly directed cam lobes whereby the rotation of said rotor relative to said cam translates the contour of said cam into sequential pumping strokes of said plungers, a regulating member connected to said cam ring to vary the angular position thereof, said regulating member comprising a piston mounted in a bore of the pump, a closed chamber at one end of said piston, means to control the quantity of liquid fuel contained in said closed chamber for controlling the position of said piston, and feedback means comprising a pivoted feedback beam member having a profiled surface and a stop member engageable therewith to provide a feedback signal to said means to control the quantity of fuel in said closed chamber, one of said members being mounted by said piston and the other of said members being mounted in a fixed position whereby the movement of said piston translates the profile of said profiled surface into said feedback signal.

18. The liquid fuel injection pump according to claim 17 wherein said control means is a servo valve and including means responsive to speed and load related signals for controlling the operation of said servo valve.

19. The liquid fuel injection pump according to claim 18 wherein said speed related signal is a hydraulic pressure correlated with engine speed which acts on said servo valve in opposition to the force of a biasing spring.

20. The liquid fuel injection pump according to claim 19 wherein said load signal comprises a hydraulic force corresponding to the quantity of fuel in a measured charge of fuel being delivered to the associated engine and to the speed of the engine, said hydraulic force being operatively connected to said servo valve to modify the operation thereof.

21. The liquid fuel injection pump according to claim 19 wherein said pivoted feedback beam member is mounted on said piston.

22. The liquid fuel injection pump according to claim 19 wherein said load related signal is generated by a cam associated with a mechanical throttle to control the position of a servo sleeve which cooperates with said servo valve to control the quantity of fuel in said closed chamber.

23. The liquid fuel injection pump according to claim 22 including a metering valve for controlling the quantity of fuel delivered to said pump chamber in each charge of fuel delivered thereto, said throttle further controlling the restriction offered by said metering valve to control the fuel delivery to the pump chamber, and further including independent means to adjust the area of the metering port according to engine speed thereby to change the restriction offered by said metering valve according to speed to provide for delivery of substantially equal charges of fuel for a given throttle setting regardless of changes in speed.

24. A liquid fuel injection pump suited for the sequential delivery of measured charges of liquid fuel under high pressure to an associated engine in timed relationship therewith comprising pump chamber means wherein the charges are pressurized to high pressure, a passage for delivering the fuel to said pump chamber means, a metering valve in said passage for regulating the amount of fuel in said measured charges of fuel, said metering valve comprising a fixed cylindrical rod and a sleeve mounted around said rod for relative axial and angular movement with respect thereto, said rod and sleeve respectively having ports in the adjacent surfaces thereof adapted for registry, mechanical means to rotate said sleeve to select the amount of angular overlap of said ports, means for controlling the axial movement of said sleeve to vary the amount of axial overlap of said ports, a second valve in said passage connected in series with said metering valve and comprising a second pair of ports respectively provided by said rod and said sleeve, said second pair of ports being normally positioned in registry with each other, and means for reducing the registry of said second pair of ports when the engine exceeds a predetermined speed.

25. A liquid fuel injection pump suited for the sequential delivery of measured charges of liquid fuel under high pressure to an associated engine in timed relationship therewith comprising a pump housing, a rotor journaled in a bore in said pump housing, a transverse bore in the rotor forming a high pressure pump chamber, a pair of pump plungers slidably mounted in said bore, an angularly shiftable cam ring surrounding said plungers and having inwardly directed cam lobes whereby the rotation of said rotor relative to said cam translates the contour of said cam into sequential pumping strokes of said plungers, a regulating member connected to said cam ring to vary the angular position thereof, said regulating member comprising a piston mounted in a bore of the pump, a closed chamber at one end of said piston, means to control the quantity of liquid fuel contained in said closed chamber for controlling the position of said piston, and feedback means comprising a pivoted feedback beam member and a second member engageable therewith to provide a feedback signal to said means to control the quantity of fuel in said closed chamber, said members being movable relative to each other with one of said members being operatively connected for movement by said piston relative to the other of said members and one of said members having a profiled surface for engagement by the other of said members whereby the movement of said piston translates the profile of said profiled surface into said feedback signal.

* * * * *

UNITED STATES PATENT AND TRADEMARK OFFICE

CERTIFICATE OF CORRECTION

PATENT NO. : 4,050,432

DATED : September 27, 1977

INVENTOR(S) : Charles W. Davis et al

It is certified that error appears in the above-identified patent and that said Letters Patent are hereby corrected as shown below:

Column 10, line 68, "17" should be --25--.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*